US010077963B1

(12) United States Patent
Popov et al.

(10) Patent No.: US 10,077,963 B1
(45) Date of Patent: Sep. 18, 2018

(54) DOUBLE LIMB FOR ARROW THROWING DEVICE AND ARROW THROWING DEVICE USING THE SAME

(71) Applicants: Sergey Popov, Moscow (RU); Vladimir Sinitsa, Moscow (RU); Liudmila Kezhina, Moscow (RU)

(72) Inventors: Sergey Popov, Moscow (RU); Vladimir Sinitsa, Moscow (RU); Liudmila Kezhina, Moscow (RU)

( * ) Notice: Subject to any disclaimer, the term of this patent is extended or adjusted under 35 U.S.C. 154(b) by 0 days.

(21) Appl. No.: 15/598,981

(22) Filed: May 18, 2017

(51) Int. Cl.

| | |
|---|---|
| ***F41B 5/00*** | (2006.01) |
| ***F41B 5/10*** | (2006.01) |
| ***F41B 5/12*** | (2006.01) |
| ***F41B 5/14*** | (2006.01) |

(52) U.S. Cl.
CPC ..... *F41B 5/1403* (2013.01); *F41B 5/00* (2013.01); *F41B 5/0094* (2013.01); *F41B 5/10* (2013.01); *F41B 5/12* (2013.01); *F41B 5/123* (2013.01)

(58) Field of Classification Search
CPC ..... F41B 5/00; F41B 5/10; F41B 5/12; F41B 5/123
See application file for complete search history.

(56) References Cited

U.S. PATENT DOCUMENTS

| | | | | | |
|---|---|---|---|---|---|
| 2,613,660 | A | * | 10/1952 | Bear | F41B 5/0084 124/23.1 |
| 3,990,425 | A | | 11/1976 | Ketchum | |
| 4,018,205 | A | * | 4/1977 | Meyer | F41B 5/0005 124/23.1 |
| 4,183,345 | A | * | 1/1980 | Caldwell | F41B 5/0094 124/25.6 |
| 4,227,509 | A | * | 10/1980 | Jones | F41B 5/0094 124/25.6 |
| 4,258,689 | A | * | 3/1981 | Barnett | F41B 5/12 124/25 |
| 4,287,867 | A | * | 9/1981 | Islas | F41B 5/10 124/25.6 |
| 5,368,006 | A | | 11/1994 | McPherson | |
| 5,388,564 | A | * | 2/1995 | Islas | F41B 5/0094 124/23.1 |
| 5,706,794 | A | * | 1/1998 | Neal | F41B 5/0094 124/23.1 |
| 2010/0206284 | A1 | | 8/2010 | Popov et al. | |

* cited by examiner

*Primary Examiner* — John Ricci
(74) *Attorney, Agent, or Firm* — Andrew W. Chu; Craft Chu PLLC

(57) ABSTRACT

The limb for an arrow throwing device, e.g. a bow or a crossbow, includes an upper portion, a lower portion, and an intermediate portion arranged between the upper portion and the lower portion. The upper portion and the lower portion are resilient. The intermediate portion is made non-resilient, capable of moving freely and not being deformed in conditions of load exerted on the limb during use thereof. The limb and the bow or the crossbow, featuring the limbs, can ensure a high speed of the arrow and a large stroke at small dimensions of the limb.

14 Claims, 5 Drawing Sheets a b a b c a b

DOUBLE LIMB FOR ARROW THROWING DEVICE AND ARROW THROWING DEVICE USING THE SAME

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

This invention relates to elements of arrow throwing devices, in particular to limbs used in bows and crossbows.

2. Description of Related Art Including Information Disclosed Under 37 CFR 1.97 and 37 CFR 1.98

A variety of bow and crossbow designs are known in the art, with limbs being the main element thereof. The purpose of the limbs is to provide a high initial speed of an arrow. This is achieved due to making the limbs of a resilient material so when a bowstring is drawn, the limbs are flexed, and when the bowstring is released the limbs are straightened up, taking the initial shape. The more the flexing (straightening) amplitude and the limb's straightening speed are, the higher the arrow's initial speed is.

In order to increase the limb's straightening speed, the limbs are made of low-resilient materials. However, it needs applying higher forces for drawing the bowstring, which requires physical strength and, additionally, creates higher loads at the points where the limbs are attached to the handle of the bow or the body of the crossbow.

In order to increase a flexing (straightening) amplitude of the limbs, the limbs are usually made large. However, this makes an arrow throwing device bulky and heavy. For the purpose of eliminating this disadvantage two or more limbs may be applied. For example, as shown in FIG. 2 of U.S. Pat. No. 4,722,317, the flexible limbs 82, 88 are attached to the handle 80. Such designs are disadvantageous in that each limb is to be attached to a very long handle of a bow, which increases the device weight and affects operation reliability thereof.

In FIG. 3 of the same U.S. Pat. No. 4,722,317 is shown another embodiment, wherein the flexible resilient limb 200 is attached with the medium portion thereof to the handle 80, and both terminal ends of the limb 200 remain free and are used for mounting the bowstring and cable securing devices, namely pulleys 92, 94, 96, 98. Fixation of the limb's medium portion results in a higher load applied to the limb portions that move when the bowstring is drawn.

It is to be noted that a limb is a resilient element intended for accumulating energy for shooting. On one end thereof, the limb is attached to a non-resilient, stationary portion of an arrow throwing device (e.g., to a handle of a bow or a body of a crossbow). A bowstring and cables, if used, are secured to the other end of the limb via bowstring securing means and cable securing means, respectively. In particular, with reference to U.S. Pat. No. 4,722,317, limbs are understood as the elements designated by reference numbers 24, 26, 82, 84, 88, 90, 200, 202. The elements designated by reference numbers 32, 34 in FIG. 1 are «stationary arms», not the limbs.

U.S. Pat. No. 6,029,644 discloses the use of bow flexible limbs one end of each of which is fixed with the possibility of limited motion. The intermediate section of each limb is made flexible and is also fixed with the possibility of limited motion. This design enables to redistribute loads exerted on the limb intermediate section when the bowstring is drawn but, essentially, reduces the limb effective length since spatial motions of the limb intermediate section is limited and consequently, the limb lower section (reference number 25), which is connected at one of the ends thereof, cannot be fully involved into energy accumulation when the bowstring is drawn and the accumulated energy is being transferred to an arrow at shooting.

A greater length of a limb and compactness of an arrow throwing device may be achieved by making limbs of complex shape. For example, US Patent Application US 2015/0136106 provides for making S-shaped limbs. Since load exerted on the limbs of S-shape is irregular along the limb, the limbs are made so as to have a variable width, namely, the maximum width proximate to a handle of a bow and the minimum width proximate to free ends which a bowstring is secured to. However, when pulleys or the like for bowstring and cables are arranged at the free ends of the limbs, it is impossible to ensure narrowing of the limb's width proximate to the free ends, as otherwise the free ends may get broken. For this reason the S-shape of the limbs disclosed in US 2015/0136106 features more flat curvature and is in fact close to the C-shape. Thus, making the limbs S-shaped can hardly be applied in various arrow throwing devices. Stresses arising in the most bent portions of such the limb may significantly reduce lifetime of the arrow throwing device. Furthermore, high accuracy is required for making the S-shaped limbs, otherwise they may bend differently; therefore, using of the clamping means 952 for different adjustments of the limb 150A and the limb 150B are suggested by US 2015/0136106.

BRIEF SUMMARY OF THE INVENTION

The objective of the invention is to provide limbs for an arrow throwing device, the limbs having such a shape and construction that ensures compactness thereof, increased lifetime, and high arrow speed simultaneously.

The technical effect of the invention is to ensure increased initial speed of an arrow while maintaining compact dimensions of the limbs and of an arrow throwing device comprising said limbs.

The above objective and technical effect are achieved in a limb for an arrow throwing device being the first object of the invention. The limb for an arrow throwing device comprises three portions: an upper portion, a lower portion and an intermediate portion, the intermediate portion being located between the upper portion and the lower portion. The upper portion and the lower portion are made resilient, and the intermediate portion is made non-resilient.

Resilience of a limb or a limb portion should be understood as capability of changing the shape, in particular, of bending when the limb or the limb portion is exposed to a load typical for loads arising in the limb or the limp portion during drawing a bowstring of an arrow throwing device.

The upper portion is connected with one end thereof to the intermediate portion. The opposite end of the upper portion is used for attaching a bowstring and cables, if used, directly thereto or via a device for securing a bowstring and/or cables installed on said opposite end of the upper portion.

The lower portion is connected at one end thereof to the intermediate portion, and the opposite end of the lower portion is secured on a frame of an arrow throwing device, i.e. on a handle of a bow or a body of a crossbow.

The intermediate portion is made non-resilient, as opposed to that disclosed in US 2015/0136106. The intermediate portion of the present invention serves as a connecting member between the upper portion and the lower portion and, at the same time, as a strengthening member of the whole limb. It enables to easily make limbs with most optimal distribution of resilience properties along the limb for the purpose of ensuring the maximum initial speed of an arrow. Furthermore, the intermediate portion enables to increase reliability and durability of operation the whole limb, when said portions of the limb are exposed to various loads each, the intermediate portion being exposed to the maximum load.

When the bowstring is being drawn, the limb according to the invention accumulates energy practically along the whole length thereof, as opposed to the limb of U.S. Pat. No. 6,029,644. This advantage over U.S. Pat. No. 6,029,644 is achieved due to that the claimed limb provides for only one region for attaching the limb to the frame of an arrow throwing device, said region being one of the ends of the lower portion. The intermediate portion, though made non-resilient under the conditions of typical loads applied, can freely move spatially when the bowstring is being drawn and released. Thus, the maximum motion amplitudes of the upper portion and the lower portion, which are connected by the intermediate portion, are used to accumulate and release energy.

Preferably, a size of the intermediate portion is significantly less than sizes of the upper portion and the lower portion. However, the size of the intermediate portion should be such that the intermediate portion is capable of performing functions of connecting the upper portion and the lower portion and being the strengthening element taking a load.

The upper portion, the intermediate portion and the lower portion may be made as a single member. In such a case it is advantageous if the intermediate portion has a cross-section area greater than cross-sections of the upper portion and the lower portion.

Alternatively, the upper portion, the intermediate portion and the lower portion may be made as separate members jointly connected. In this case it is easier to provide each portion of the limb with resilience, shape and other characteristics required for ensuring the maximum initial speed of an arrow.

In particular, at least two portions selected from the upper portion, the intermediate portion and the lower portion may be made of different materials. In particular, the upper portion and the lower portion may have different resilience; the intermediate portion may be made of a lighter or heavier material than that of the upper portion and lower portion; etc.

Furthermore, the upper portion, the intermediate portion and the lower portion may be connected therebetween with the possibility of disconnection thereof. This ensures compactness of both the limbs and the arrow throwing device when disassembled as well as enables to easily replace the portions of the limbs, if necessary.

The limb may have various shapes. For example, the upper portion and the lower portion may be arranged at an angle to each other, and the intermediate portion may be arranged at the vertex of said angle. According to an alternative embodiment, the upper portion and the lower portion may be arranged essentially along one line. The shape of the limb determines general dimensions and, consequently, weight of the limb, as well as the initial speed of an arrow.

Another object of the invention is a bow with limbs according to the above-described limbs. In particular, the bow comprises two limbs, where each limb features a first limb end and a second limb end; means for securing a bowstring installed at said first limb ends; a handle on which said two limbs are installed with second ends thereof; and a bowstring. Each limb comprises an upper portion, a lower portion and an intermediate portion. The intermediate portion is arranged between the upper portion and the lower portion. The upper portion and the lower portion are resilient, and the intermediate portion is non-resilient.

Yet another object of this invention is a crossbow, wherein the above-described limbs are used. In particular, the crossbow comprises two limbs, where each limb features a first limb end and a second limb end; means for securing a bowstring installed at said first limb ends; a body on which said two limbs are installed with second ends thereof; and a bowstring. Each limb comprises an upper portion, a lower portion and an intermediate portion. The intermediate portion is arranged between the upper portion and the lower portion. The upper portion and the lower portion are resilient, and the intermediate portion is non-resilient.

The bow and the crossbow may include any of the above-described embodiments of the limbs. It is obvious that in such a case the advantages of the above-described embodiments of the limbs relate to such the bow and the crossbow as well.

DETAILED DESCRIPTION OF THE INVENTION

Figure 3:
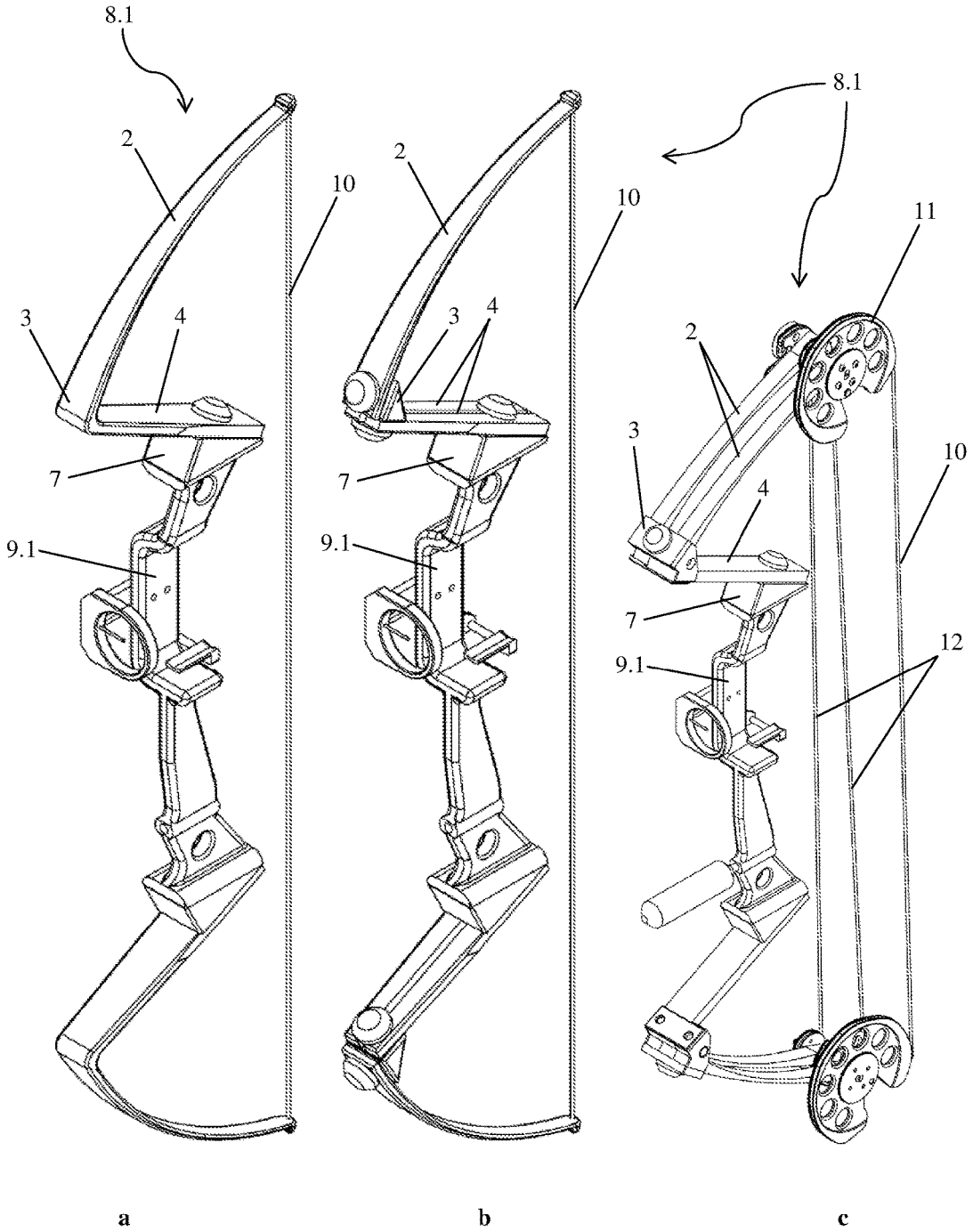
FIG. 3 shows perspective views of embodiments of a bow according to the invention.

A limb 1 according to the invention comprises an upper portion 2, an intermediate portion 3 and a lower portion 4. At an end 5 of the lower portion 4 connecting means 7 for connecting to an arrow throwing device—a bow 8.1 or a crossbow 8.2—can be attached. A bowstring 10 is secured directly to a free end 6 of the upper portion 2 (FIGS. 3*a*, 3*b*, 4) or with the use of securing means 11 for securing the bowstring 10, e.g., a block (FIGS. 3*c*, 5*a*, 5*b*).

The upper portion 2 and the lower portion 4 of the limb 1 are made resilient, so, when the bowstring 10 is being drawn, said portions 2, 4 are bended, i.e. change their shape, and when the bowstring 10 is released, said portions 2, 4 return to their initial positions, i.e. take the initial shape. The intermediate portion 3 is not deformed, i.e. does not change its shape when using the limb, and in this sense the intermediate portion 3 is non-resilient.

The invariable shape, lack of deformation in the intermediate portion 3 means that the intermediate portion 3 is not involved in energy accumulation when the bowstring 10 is being drawn and in subsequent transfer of the accumulated energy to an arrow when the bowstring 10 is released. Energy is accumulated and transferred only due to bending of the upper portion 2 and the lower portion 4 of the limb 1, the limb 1 being attached to the arrow throwing device only via the end 5 of the lower portion 4, and the bowstring 10 is secured to the opposite end of the limb 1, namely to the free end 6 of the upper portion 2, either directly or via the securing means 11. When drawing the bowstring 10 the bend occurred practically along the whole length of the limb 1, except for the region where the intermediate portion 2 is arranged, enables to make draw of the bowstring 10 more smooth and simple with large amplitude, which ensures a high initial speed of the arrow. The most loaded portion of the limb 1, namely the intermediate portion 2, is made non-resilient, i.e. not bending, not changing its shape when the bowstring 10 is being drawn, and, consequently, it is not subjected to high wear during operation of the limb 1.

Figure 1:
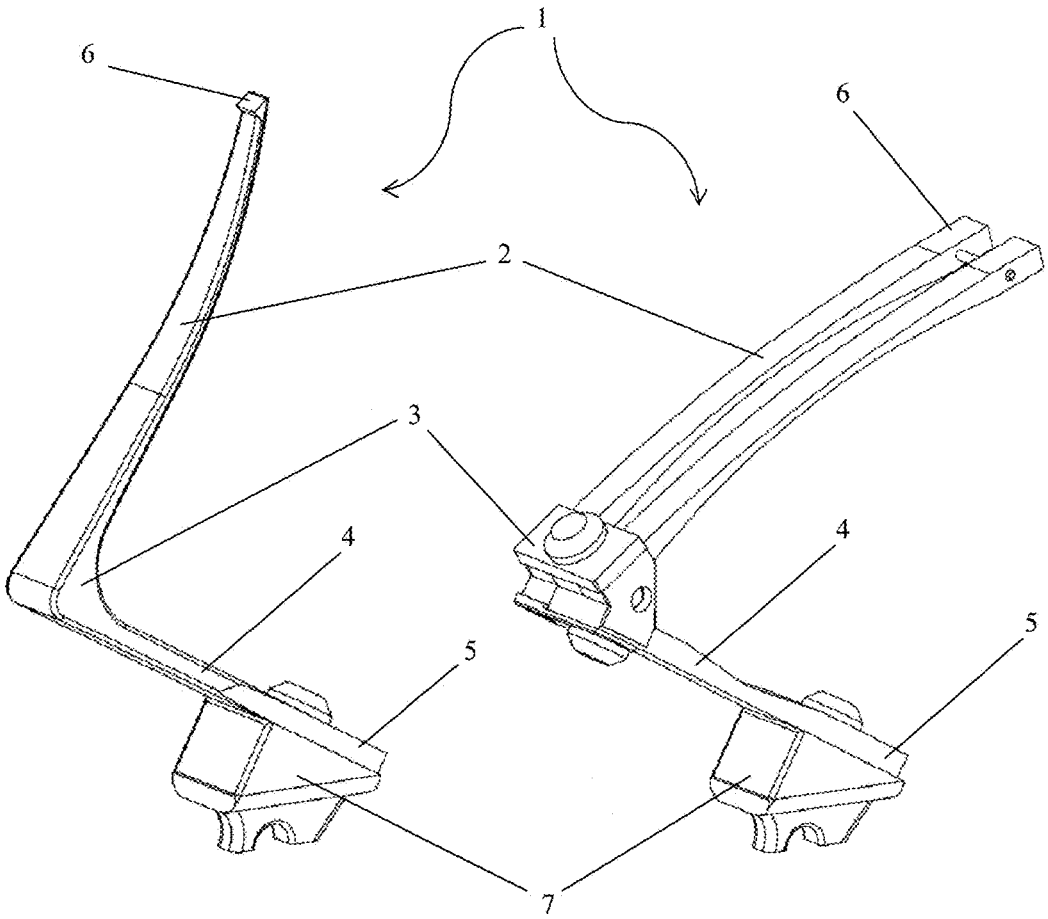
FIG. 1 shows perspective views of embodiments of a curved (extending in different directions) limb according to the invention.

The upper portion 2, the intermediate portion 3 and the lower portion 4 of the limb 1 may be made as a single element, as shown in FIG. 1*a*. In this case, in order to ensure non-resilient properties of the intermediate portion 3 during operation of the limb 1, the intermediate portion 3 is made, for example, with a cross-section that is greater than cross-sections of the upper portion 2 and the lower portion 4. One with ordinary skill in the art will understand how should relate the cross-sections of the upper portion 2, intermediate portion 3 and the lower portion 4 of the limb 1 in order to make the intermediate portion 3 not changing the shape thereof during conventional use of the limb in the bow 8.1 or the crossbow 8.2.

Alternatively, the upper portion 2 and the lower portion 4 of the limb 1 may be made as individual members connected through the intermediate portion 2, as shown in FIG. 1*b*. In this case non-resilient properties of the intermediate portion 3 may be provided not only due to increased cross-section, but due to, for example, use of another material which, at typical loads exerted on the limb 1, allows the intermediate portion 3 keeping the shape thereof. It should be noted that in this embodiment the intermediate portion 3 may be also an individual member, or may form a single member either with the upper portion 2 or the lower portion 4.

Figure 2:
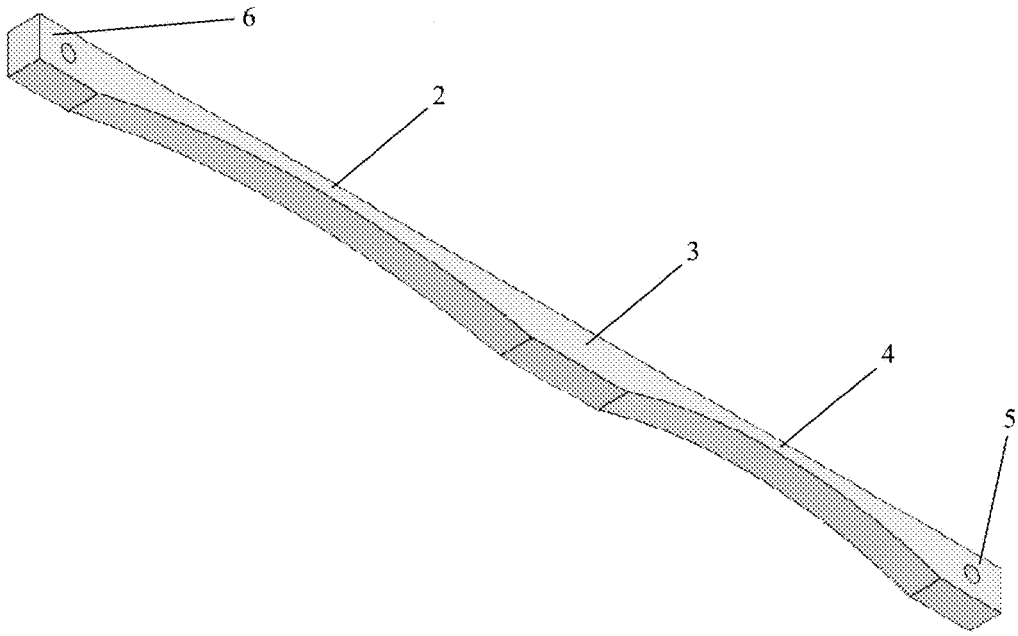
FIG. 2 shows perspective and side schematic views of embodiments of a straight (unidirectional) limb according to the invention.
Figure 2:
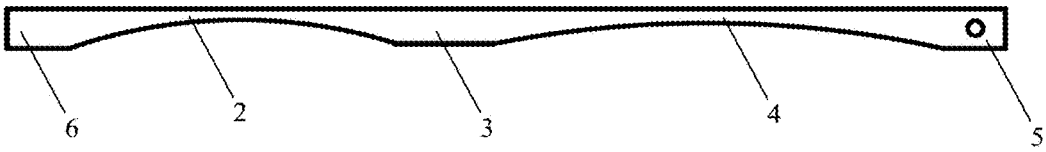
Figure 2:
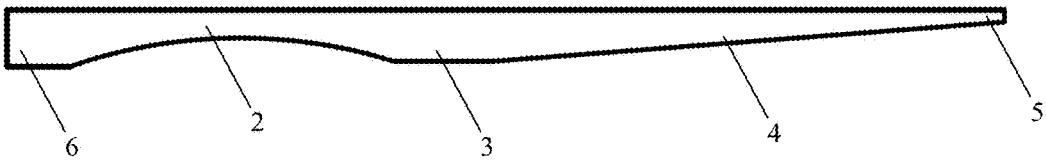

The limb 1 according to the invention may be not only curved, or extending in different directions (the upper portion 2 and the lower portion 4 of the limb 1 are arranged at an angle to each other even in complete absence of action from the bowstring 10), as shown in FIGS. 1*a*, 1*b*, but also essentially straight (in complete absence of action from the bowstring 10), or unidirectional, as shown in FIGS. 2*a*, 2*b*, 2*c*. In the latter case, the upper portion 2, the intermediate portion 3 and the lower portion 4 are arranged nearly along one line. The condition for resilience of the intermediate portion 2 is still valid, namely, the intermediate portion 2 should be non-resilient under load in the conventional operation mode of the limb 1. The shapes of the upper portion 2, the intermediate portion 3 and the lower portion 4 of the limb 1 may be different.

The upper portion 2 and/or the lower portion 4 of the limb 1 may be made as one-piece members or may consist of several elements. For example, as shown in FIG. 3*a*, the upper portion 2 and the lower portion 4 of the limb 1 are made each as a one-piece member. FIG. 3*b* shows an embodiment wherein the upper portion 2 is made as a one-piece member, and the lower portion 4 consists of two elements. FIGS. 3*c*, 5*a*, 5*b* show another embodiment wherein the upper portion 2 consists of two elements, and the lower portion 4 is made as a single member. It is also possible to make the upper portion 2 and the lower portion 4 consisting of two elements each.

FIGS. 3*a*, 3*b*, 3*c* show embodiments of a bow according to this invention. The limbs 1 are attached to a handle 9.1 with the ends 5 of the lower portion 4, and the bowstring 10 is secured to the ends 6 of the upper portion 2. The bowstring 10 may be secured to the ends 6 in the way shown in FIG. 3*a*, 3*b*, or via the securing means 11 made, e.g., as a block shown in FIG. 3*c*. If the securing means 11 is used, the bow 8.1 may also comprise one or more cables 12.

Figure 4:
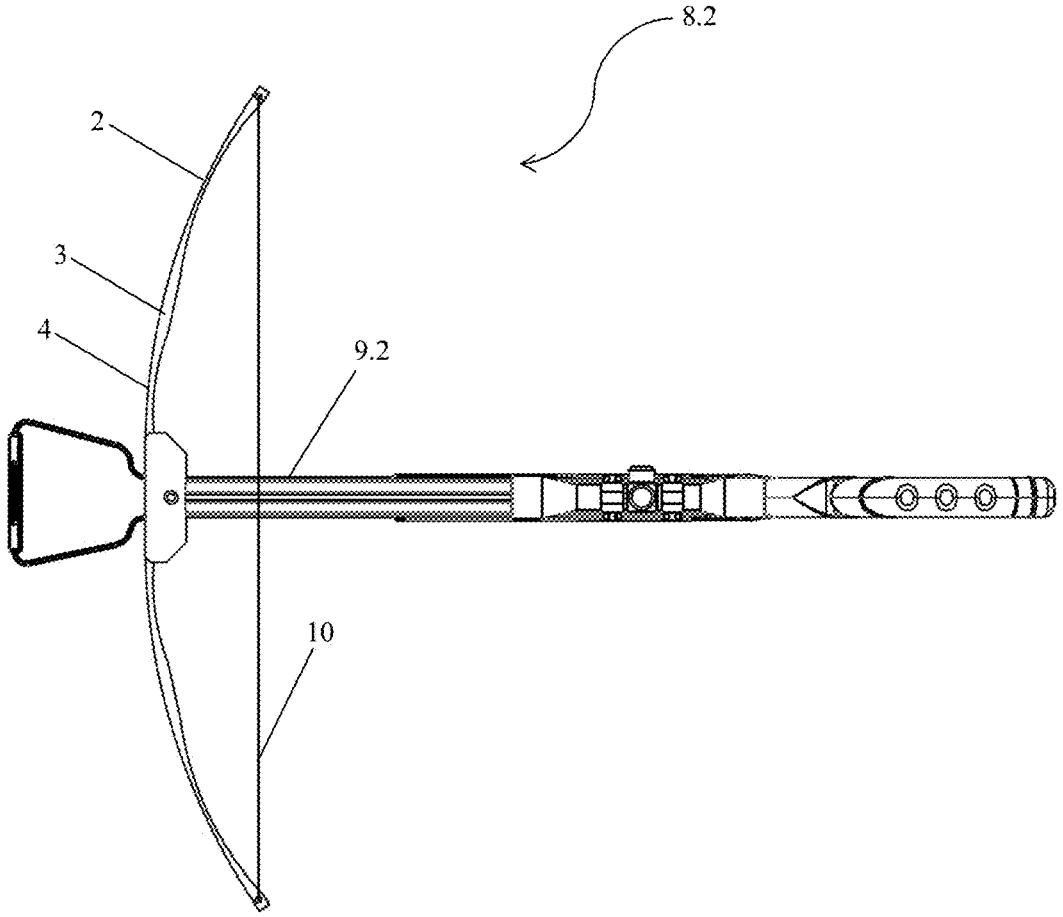
FIG. 4 shows top plan view of an embodiment of a crossbow with straight (unidirectional) limbs.
Figure 5:
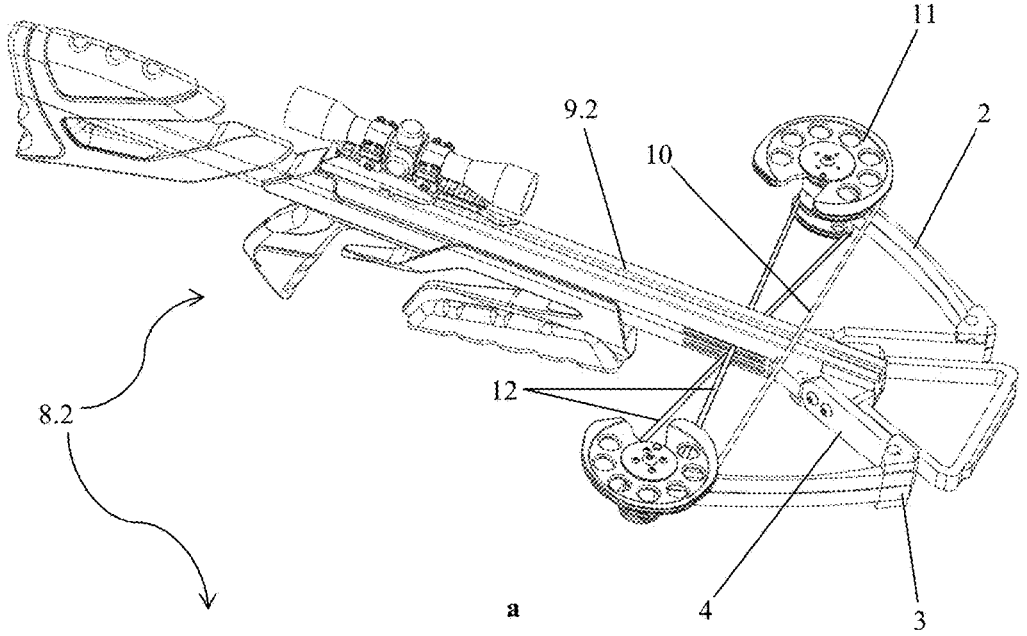
FIG. 5 shows upper and lower perspective views of embodiments of a crossbow with curved (extending in different directions) limbs.
Figure 5:
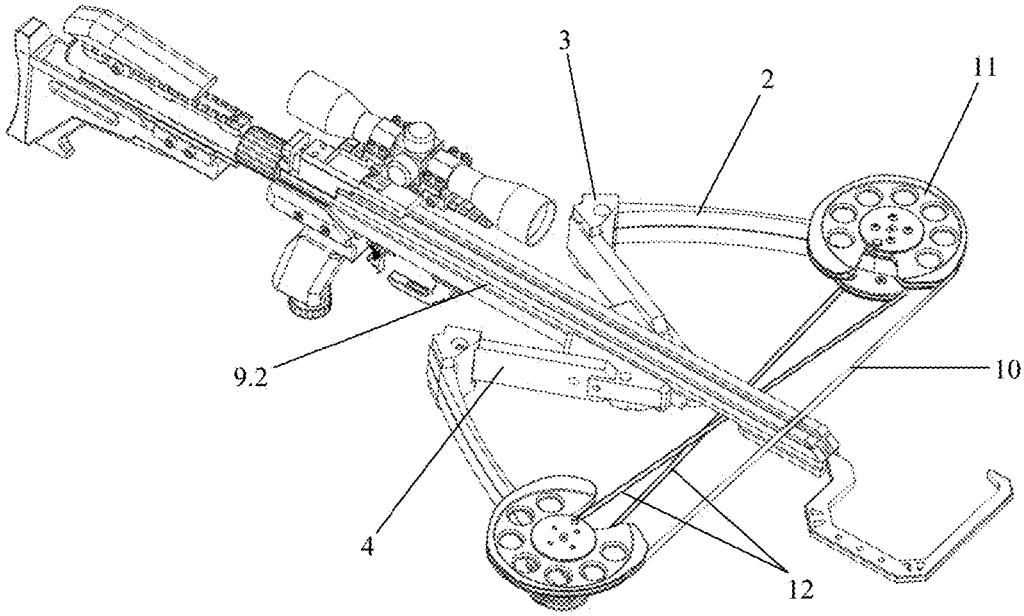

FIG. 4 shows an embodiment of a crossbow according to the invention, wherein the lower portion 4 of the limb is attached to a body 9.2 of the crossbow, and the bowstring 10 is secured to the ends 6 of the upper limb 2 directly. Alternatively, in the embodiments of the crossbow according to the invention, as shown in FIGS. 5*a*, 5*b*, the bowstring 10 is secured to the ends 6 of the upper limb 2 via the securing means 11.

Strengthening of the limb 1 in the region of the intermediate portion 3 by making the intermediate portion 3 non-resilient in conventional operation of the limb 1 enables to use practically the whole length of the limb 1 for accumulating energy and to ensure stability of the most loaded intermediate portion 3 at various loads. This principle may be applied to the limbs 1 of any shape, both unidirectional and extending in different directions.

The proposed limb and the bow or the crossbow featuring said limbs ensure a high speed of the arrow and a large stroke at small dimensions of the limb.

We claim:

1. A bow comprising:

two limbs, each limb having a first end and a second end;

a bowstring;

securing means for the bowstring arranged on said first ends of said limbs; and a handle on which said two limbs are installed with their second ends, wherein each limb comprises:

an upper portion having one upper portion end and an opposite upper portion end;

a lower portion having one lower portion end and an opposite lower portion end; and an intermediate portion arranged between the upper portion and the lower portion, wherein said one upper portion end connects to said intermediate portion, said opposite upper portion end forming a respective first end of each limb, wherein said one lower portion end connects to said intermediate portion, said opposite lower portion end forming a respective second end of each limb, wherein the upper portion and the lower portion are resilient, and wherein the intermediate portion is non-resilient, capable of moving freely and being not deformed in conditions of load exerted on the limb during use thereof.

2. The bow according to claim 1, further comprising at least one cable and attachment means for said at least one cable being installed on each of the first ends.

3. The bow according to claim 1, wherein the upper portion, the intermediate portion and the lower portion of each of the limbs are made as a single member.

4. The bow according to claim 1, wherein the upper portion, the intermediate portion and the lower portion of each of the limbs are made as separate elements connected therebetween.

5. The bow according to claim 4, wherein for each of the limbs at least two portions selected from the upper portion, the intermediate portion and the lower portion are made of different materials.

6. The bow according to claim 4, wherein for each of the limbs the upper portion, the intermediate portion and the lower portion are connected therebetween with the possibility of being separated.

7. The bow according to claim 1, wherein for each of the limbs resilience of the upper portion differs from resilience of the lower portion.

8. A crossbow comprising:

two limbs, each limb having a first end and a second end;

a bowstring;

securing means for the bowstring arranged on said first ends of said limbs; and a body on which said two limbs are installed with their second ends, wherein each limb comprises:

an upper portion having one upper portion end and an opposite upper portion end;

a lower portion having one lower portion end and an opposite lower portion end; and an intermediate portion arranged between the upper portion and the lower portion, wherein said one upper portion end connects to said intermediate portion, said opposite upper portion end forming a respective first end of each limb, wherein said one lower portion end connects to said intermediate portion, said opposite lower portion end forming a respective second end of each limb, wherein the upper portion and the lower portion are resilient, and wherein the intermediate portion is non-resilient, capable of moving freely and being not deformed in conditions of load exerted on the limb during use thereof.

9. The crossbow according to claim 8, further comprising at least one cable and attachment means for said at least one cable being installed on each of the first ends.

10. The crossbow according to claim 8, wherein the upper portion, the intermediate portion and the lower portion of each of the limbs are made as a single member.

11. The crossbow according to claim 8, wherein the upper portion, the intermediate portion and the lower portion of each of the limbs are made as separate elements connected therebetween.

12. The crossbow according to claim 11, wherein for each of the limbs at least two portions selected from the upper portion, the intermediate portion and the lower portion are made of different materials.

13. The crossbow according to claim 11, wherein for each of the limbs the upper portion, the intermediate portion and the lower portion are connected therebetween with the possibility of being separated.

14. The crossbow according to claim 8, wherein for each of the limbs resilience of the upper portion differs from that of the lower portion.

* * * * *